US008893647B2

(12) United States Patent
Iwashima et al.

(10) Patent No.: US 8,893,647 B2
(45) Date of Patent: Nov. 25, 2014

(54) PATTERN FORMING APPARATUS

(75) Inventors: Masanobu Iwashima, Kyoto (JP); Masakazu Sanada, Kyoto (JP); Hiroyuki Ueno, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 218 days.

(21) Appl. No.: 13/531,206

(22) Filed: Jun. 22, 2012

(65) Prior Publication Data

US 2013/0047919 A1 Feb. 28, 2013

(30) Foreign Application Priority Data

Aug. 29, 2011 (JP) ..... 2011-185558

(51) Int. Cl.

| | |
|---|---|
| ***B05C 3/00*** | (2006.01) |
| ***B05C 5/02*** | (2006.01) |
| ***B05B 3/00*** | (2006.01) |
| ***B05C 13/02*** | (2006.01) |
| ***B05C 17/005*** | (2006.01) |

(52) U.S. Cl.

CPC ..... *B05C 5/0212* (2013.01); *B05C 17/00516* (2013.01)

USPC ..... 118/410; 118/323; 118/305; 118/300; 239/601

(58) Field of Classification Search

USPC ..... 118/300, 305, 410, 323, 321; 239/589–602

See application file for complete search history.

(56) References Cited

U.S. PATENT DOCUMENTS

| | | | | |
|---|---|---|---|---|
| 5,340,433 | A * | 8/1994 | Crump | 156/578 |
| D569,477 | S * | 5/2008 | Fulkerson et al. | D23/213 |
| 2004/0124251 | A1 * | 7/2004 | Gressett et al. | 239/1 |

FOREIGN PATENT DOCUMENTS

| | | | |
|---|---|---|---|
| JP | 2007-222770 | | 9/2007 |
| JP | 2007335084 | A | 12/2007 |
| JP | 2008-104998 | A | 5/2008 |

OTHER PUBLICATIONS

Korean Office Action issued in Korean Patent Application No. 10-2012-0079187 mailed Nov. 12, 2013.

Korean Office Action issued in Korean Application No. 10-2012-0079187 dated Feb. 4, 2014.

* cited by examiner

*Primary Examiner* — Yewebdar Tadesse

(74) *Attorney, Agent, or Firm* — McDermott Will & Emery LLP

(57) ABSTRACT

A tip section of a discharge nozzle 31 is shaped like a wedge, and projections 310 which further protrude are formed at the tip of the wedge. Lower surfaces 310*b* of the projections 310 define a substrate-facing-surface which is brought into proximity to the substrate, and discharge outlet bearing surfaces 310*c*, which gradually retract back from the substrate W, are formed as if to rise from the edges of the lower surfaces 310*b*. At adjacent positions within the discharge outlet bearing surface 310*c* which are adjacent to the substrate-facing-surface 310*b*, discharge outlets 311 for discharging an application liquid are opened. Areas around the discharge outlets 311 and a wall around a fluid feeding path 312 are integrated with each other.

9 Claims, 7 Drawing Sheets

PATTERN FORMING APPARATUS

CROSS REFERENCE TO RELATED APPLICATION

The disclosure of Japanese Patent Application No.2011-185558 filed on Aug. 29, 2011 including specification, drawings and claims is incorporated herein by reference in its entirety.

BACKGROUND OF THE INVENTION

1. Field of the Invention

The present invention relates to a pattern forming apparatus which applies an application liquid containing a pattern forming material upon a substrate surface and forms a pattern.

2. Description of the Related Art

Among techniques for forming a predetermined pattern on a substrate surface is a technique which requires applying onto a substrate surface an application liquid containing a pattern-forming material and curing the application liquid, and various techniques to realize this have been proposed. For instance, JP2007-222770A discloses a structure of a nozzle which can be applied to the pattern forming technique mentioned above. According to the technique described in this patent publication, the tip of the nozzle is formed by laying one atop the other a plurality of parts which have dents, grooves and the like which serve as a feeding path for the application liquid so that it is possible to disassemble the nozzle. The parts are firmly held from outside in an attempt to prevent leakage from gaps between the parts.

However, an even higher aspect ratio of patterns and an even faster speed of forming the patterns than before are demanded these days. That is, the requirement is to form a pattern having a high ratio of the height of the pattern to the width of the pattern (aspect ratio) in an even shorter period of time than before. To realize this, it is necessary to develop a technique which achieves extrusion of a highly viscous application liquid with an even greater pressure (such as 1 MPa or greater) than in the past. The conventional nozzle structure described above sometimes fails to fully meet this requirement. In more specific terms, a pressure loss is created as the high inner pressure slightly bends and distorts the nozzle parts or as the liquid leaks out from the gaps between the parts due to the capillary effect. This from time to time makes it impossible to perform appropriate discharge control which is for controlling the cross-sectional shape, the amount or the like of the application liquid which is discharged at a discharge outlet.

SUMMARY OF THE INVENTION

The invention has been made in light of the problems described above. Accordingly, an object of the invention is to provide, for a pattern forming technique for applying an application liquid to a substrate and accordingly forming a predetermined pattern, a pattern forming apparatus which is capable of extruding the application liquid with a high pressure and properly controlling discharging.

To achieve the above object, a pattern forming apparatus of the invention comprises: a substrate holder which horizontally holds a substrate; a discharge head which is disposed opposed to a surface of the substrate which is held by the substrate holder, the discharge head discharging an application liquid which contains a material for forming a pattern; and a moving member which makes the substrate held by the substrate holder move relative to the discharge head so that the discharge head moves in a predetermined scanning direction along the surface of the substrate, wherein the discharge head comprises a fluid reservoir part for storing the application liquid inside, a discharge outlet for discharging the application liquid and a fluid feeding path for supplying the application liquid from the fluid reservoir part to the discharge outlet, a lower section of the discharge head contains a substrate-facing-surface which is approximately parallel to the surface of the substrate and a discharge outlet bearing surface which comes into contact with the substrate-facing-surface at the rear-side end of the substrate-facing-surface taken along the scanning direction and recedes from the surface of the substrate with a distance away from the rear-side end, and the discharge outlet is provided at an adjacent position within the discharge outlet bearing surface which is adjacent to the rear-side end of the substrate-facing-surface, and a side wall of the fluid feeding path and the discharge outlet are formed as one integrated member.

With this structure according to the invention, the fluid feeding path from the fluid reservoir part to the discharge outlet and the discharge outlet are formed as a single member. This obviates a problem of oozing out of the application liquid from a seam between more than one parts. It is therefore possible to feed the application liquid under a high pressure from the fluid reservoir part to the discharge outlet, while suppressing instable discharging due to a pressure loss.

The discharge outlet in the discharge outlet bearing surface of the lower section of a discharge head is provided at a position which is adjacent to the rear-side end of the substrate-facing-surface which contacts the discharge outlet-bearing surface. Hence, in a condition that the discharge head stays opposed to the surface of the substrate, the distance from the lower end of the discharge outlet to the surface of the substrate is approximately the same as the distance from the substrate-facing-surface to the surface of the substrate. As the substrate-facing-surface is brought into proximity to the surface of the substrate, the lower end of the discharge outlet comes extremely close to the surface of the substrate. This allows the application liquid from the discharge outlet to immediately land at the surface of the substrate without staying at or around the discharge outlet or falling toward the substrate, and to remain on the surface of the substrate because of adhesion to the surface of the substrate. The application liquid is thus smoothly transferred from inside the discharge head to the surface of the substrate, which makes it easy to control the cross-sectional shape of the discharged application liquid.

Owing to the structure and the effect above, it is possible according to the invention to push out the application liquid with a high pressure and apply the application liquid while appropriately controlling discharging. It is therefore possible to form a pattern having a controlled cross-sectional shape or a controlled size at a high speed.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 1 is a drawing which shows an example of a pattern forming apparatus which the present invention is applicable to;

DETAILED DESCRIPTION OF THE PREFFERED EMBODIMENTS

Figure 1:
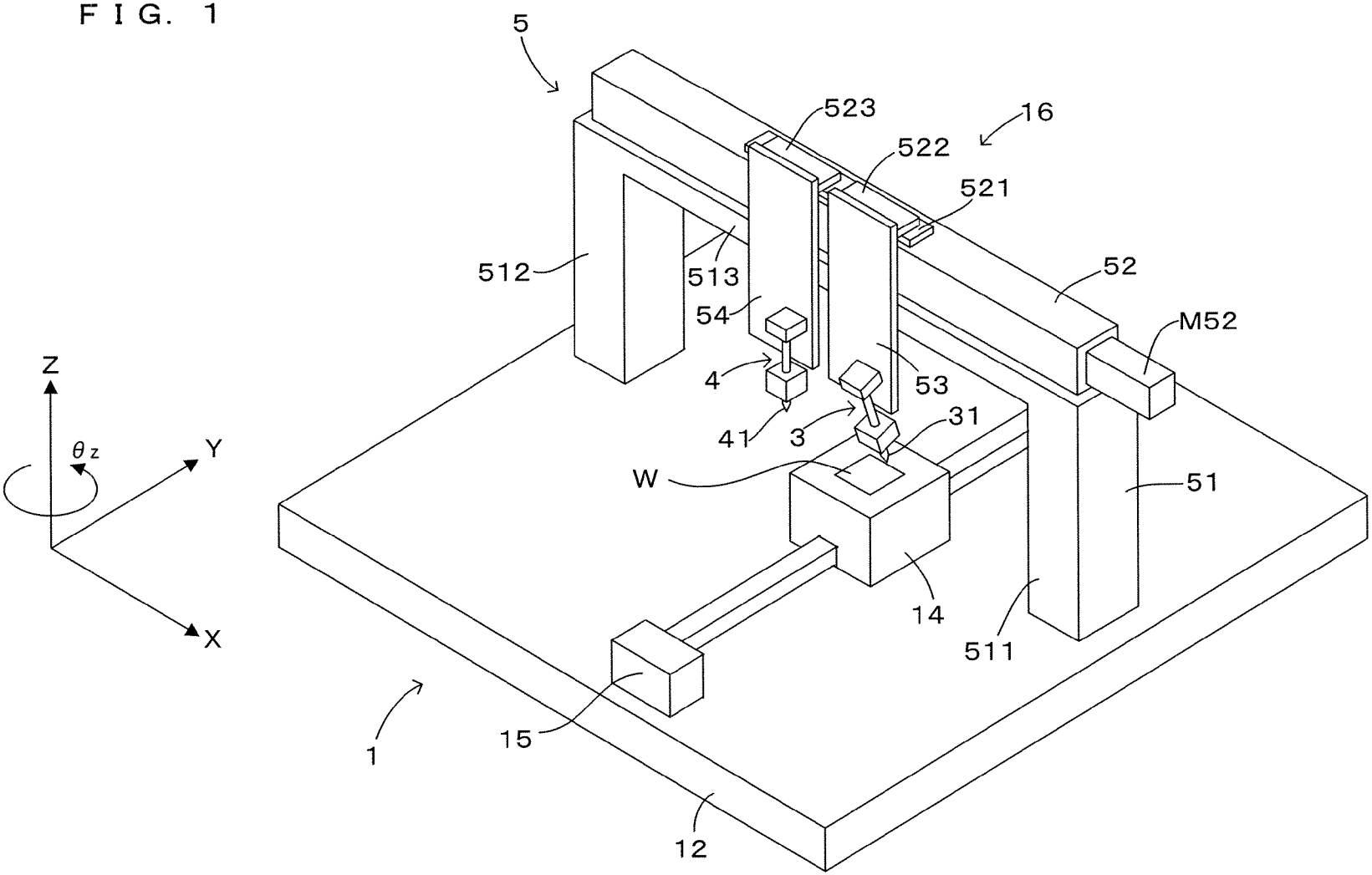

FIG. 1 is a drawing which shows an example of a pattern forming apparatus which the present invention is applicable to. In describing it below, the XYZ orthogonal coordinate axes and the θz rotational coordinate axis around the Z-axis defined as shown in FIG. 1 will be used when appropriate to indicate a direction. Further, the directions of the arrows indicative of the respective coordinate axes will be referred to as the positive directions and the opposite directions to the arrows indicative of the respective coordinate axes will be referred to as the negative directions.

The pattern forming apparatus 1 is an apparatus which forms a conductive electrode wiring pattern in a substrate W, such as a single-crystal silicon wafer, which seats on its surface a photoelectric conversion layer and accordingly manufactures a photoelectric conversion device which is used as a solar battery for example. The apparatus 1 can be used favorably for the purpose of forming a current collecting electrode pattern including a finger electrode and a bus electrode in the light incident surface of the photoelectric conversion device for instance.

The pattern forming apparatus 1 comprises a base 12, and a stage 14 which supports on its top surface the substrate W is mounted on the base 12. Driven by a stage moving mechanism 15 comprising an appropriate drive mechanism, the stage 14 moves in the Y-axis direction and revolves in the θz-axis direction. In addition, a discharge apparatus 16 is supported on the base 12 inside the pattern forming apparatus 1.

The discharge apparatus 16 is for discharging the application liquid which contains a material for forming a pattern, and is for forming a pattern on the substrate W which is supported by the stage 14. Describing in more specific terms, the discharge apparatus 16 comprises two discharge units 3 and 4 which are disposed side by side in the X-axis direction. The discharge units 3 and 4 are configured so as to be able to move in the X-axis direction. As one of the discharge units 3 and 4 selectively comes to a position above the route along the Y-axis direction for the stage 14 and discharges the application liquid, a linear pattern extending in the Y-axis direction is formed within the surface of the substrate W which moves below the discharge unit.

The application liquid may for instance be a conductive paste, namely, a paste-like conductive and photo-curing mixture solution which contains conductive particles, an organic vehicle (which is a mixture of a solvent, a resin, a thickener, etc.) and a photo-polymerization initiator. The conductive particles may for example be silver powder which is a material of an electrode, while the organic vehicle may contain ethylcellulose, which serves as a resin material, and an organic solvent. The reason of using the photo-curing application liquid is to fix the shape of a pattern with irradiation of light after discharging the application liquid onto the substrate W and accordingly forming the pattern.

The discharge apparatus 16 further comprises a first support mechanism 5 which supports the discharge units 3 and 4 above the stage 12. The first support mechanism 5 comprises a gantry 51, a linear guide 52 attached to the top side of the gantry 51, and two flexure members 522 and 523 which are attached to a slide table 521 of the linear guide 52. The gantry 51 is formed by two pillars 511 and 512 which are arranged side by side in the X-axis direction so as to enclose the Y-axis direction route for the stage 14 in the X-axis direction, and a beam 513 parallel to the X-axis direction and which traverses and bridges the pillars 511 and 512 from above. The gantry 51 crosses the Y-axis direction route for the stage 14 in the X-axis direction. The linear guide 52 is attached to the top surface of the beam 513 of the gantry 51. The slide table 521 of the linear guide 52, subjected to drive force via a ball screw mechanism not shown from a motor M52 disposed at an X-axis direction end of the linear guide 52, can move in the X-axis direction over the linear guide 52.

Two flexure members 522 and 523 having the same structure which is obtained by bending a flat plate by 90 degrees are attached to the top surface of the slide table 521 side by side along the X-axis direction. An upright base 53 is attached to the slide table 521 via the flexure member 522, and so is an upright base 54 to the slide table 521 via the flexure member 523. The upright bases 53 and 54 both have a shape like a flat plate which extends in the upright direction and are positioned parallel to the ZX plane (i.e., orthogonally to the Y-axis direction). The upright bases 53 and 54 are screwed in their top sections respectively to the flexure members 522 and 523, and elongate down beyond the beam 513 passed the side surface of the beam 513 which is toward the Y-axis negative direction. The upright bases 53 and 54 are thus positioned on one side to the beam 513 (i.e., on the Y-axis negative side), and are supported by the beam 513 in such a manner that the upright bases 53 and 54 can move in the X-axis direction.

The discharge unit 3 is attached to a lower area of the upright base 53 which extends downward beyond the beam 513, and in a similar fashion, the discharge unit 4 is attached to a lower area of the upright base 54. The discharge units 3 and 4 are therefore capable of moving in the X-axis direction together respectively with the upright bases 53 and 54.

The discharge unit 3 is for discharging the application liquid onto the substrate W for the purpose of forming a finger electrode, and is supported at an angle toward the Y-axis direction relative to the Z-axis direction. The direction of discharging from the discharge unit 3 is therefore tilted toward the Y-axis direction relative to the Z-axis direction. Meanwhile, the discharge unit 4 is for discharging the application liquid onto the substrate W for the purpose of forming a bus electrode, and is supported parallel to the Z-axis direction. The direction of discharging from the discharge unit 4 is therefore parallel to the Z-axis negative direction. The manner in which the discharge unit 4 is supported can be modified appropriately so as to support the discharge unit 4 at an angle toward the Y-axis direction relative to the Z-axis direction as in the case of the discharge unit 3.

The discharge units 3 and 4 discharge the application liquid onto the substrate W respectively from discharge nozzles 31 and 41 which are disposed at the lower ends of the discharge units 3 and 4 respectively. More specifically, the discharge nozzles 31 and 41 discharge the application liquid at their discharge outlets which are opened at the tip sections of the discharge nozzles 31 and 41 respectively. The discharge nozzles 31 and 41 can be attached to and detached from the discharge units 3 and 4, and therefore, in accordance with the purpose, the discharge nozzles 31 and 41 having the necessary number of discharge outlets may be attached and used to form patterns. In the illustrated example, the discharge nozzle 41 has one relatively wide discharge outlet and is used for forming a wide bus electrode pattern in the substrate W. Meanwhile, the discharge nozzle 31 has a plurality of small discharge outlets and is used for forming a number of finger electrode patterns which are thin and parallel to each other.

Describing in more particular terms, each electrode is formed in the substrate W in the following manner. First, the stage 14 is brought to a travel start position which is on the Y-axis negative side relative to the discharge units 3 and 4, and the discharge unit 3 for finger electrodes moves to above the Y-axis direction route for the stage 14. As the stage 14 starts moving toward the Y-axis positive direction from this state, the discharge unit 3 for finger electrodes discharges the application liquid onto the substrate W which moves below the discharge unit 3, whereby the same number of finger electrodes as the number of the discharge outlets are formed on the substrate W. This operation is performed while changing the position of the stage 14 taken along the X-direction relative to the discharge unit 3 in accordance with the necessary number of electrodes, the predetermined number of finger electrodes are formed on the substrate W. After the finger electrodes are thus formed, the stage 14 moves toward the Y-axis negative direction, and revolves 90 degrees in the θz-axis direction while returning back to the travel start position mentioned earlier. Concurrently with these motions made by the stage 14, the discharge unit 4 for bus electrodes moves to above the Y-axis direction route for the stage 14. The stage 14 starts moving toward the Y-axis positive direction upon completion of these motions, and the discharge unit 4 discharges the application liquid onto the substrate W which moves below the discharge unit 4, whereby the predetermined number of bus electrodes are formed on the substrate W. In this embodiment, the discharge units 3 and 4 thus move relative to the stage 14 as the stage 14 moves so that patterns are formed on the substrate W. The sequence of discharging by the discharge units 3 and 4 is not limited to the sequence above and may be opposite to the sequence above.

Figure 2:
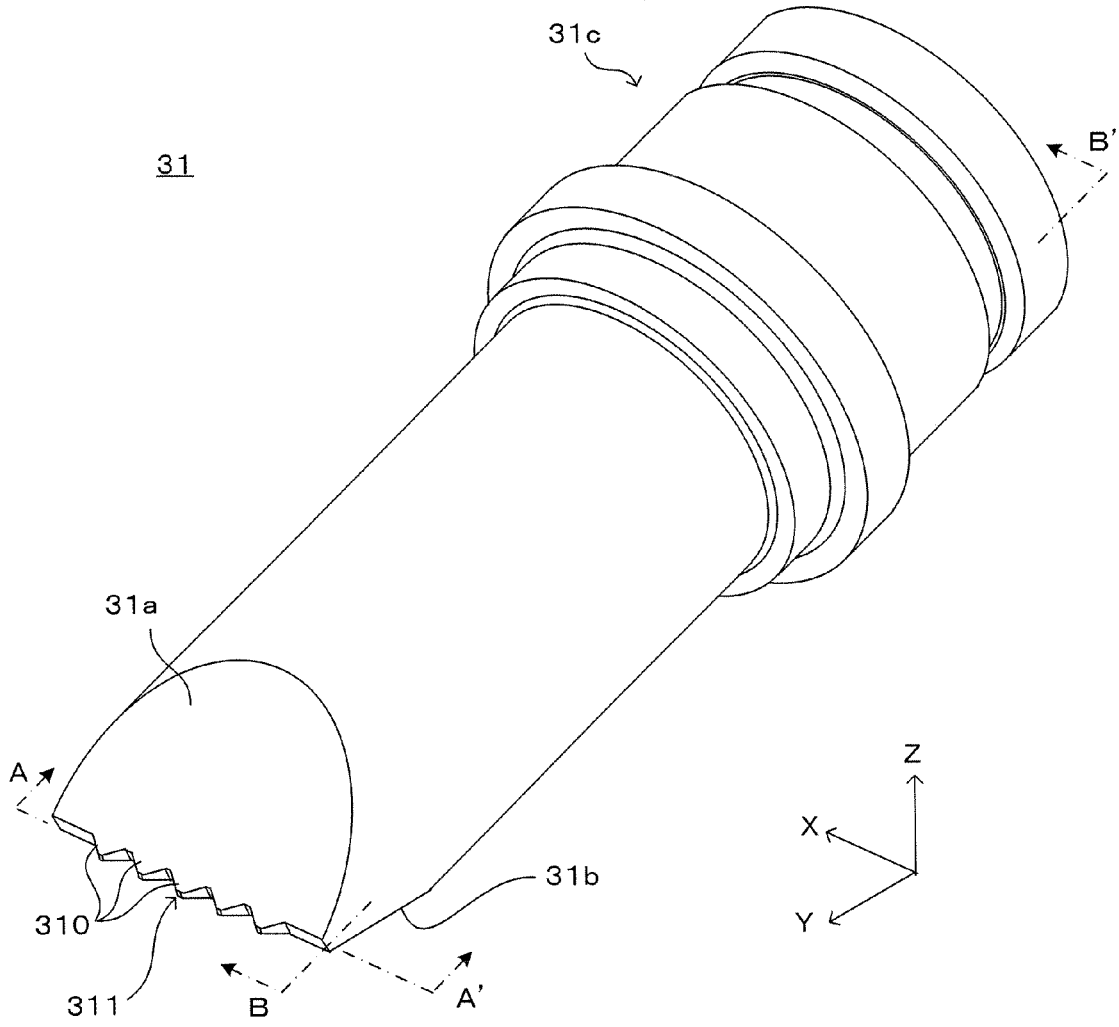
FIG. 2 is a drawing which shows the appearance of the discharge nozzle.
Figure 3A:
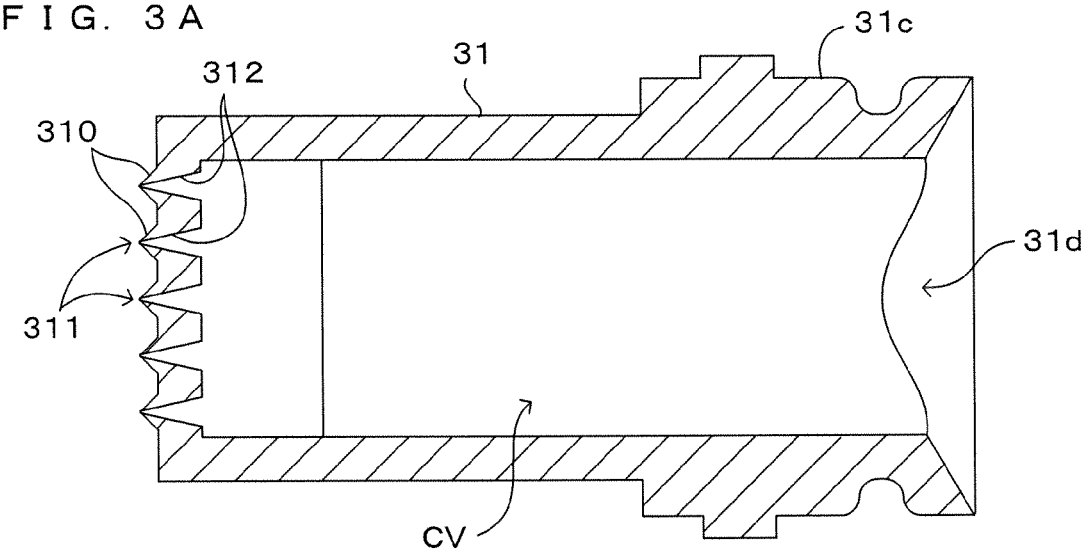
FIGS. 3A and 3B are drawings which show the internal structure of the discharge nozzle.
Figure 3B:
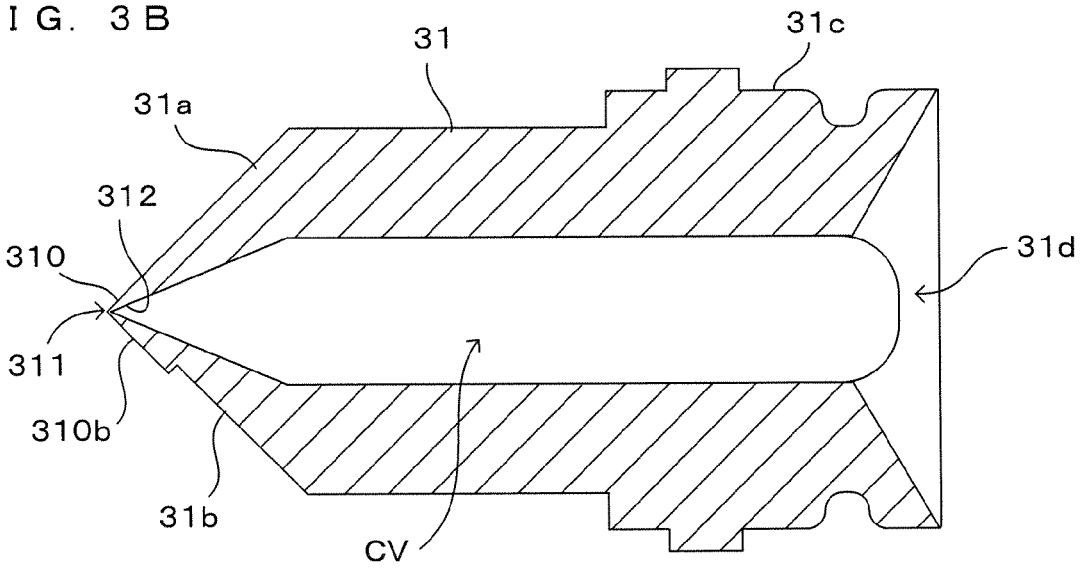

FIG. 2 is a drawing which shows the appearance of the discharge nozzle. FIGS. 3A and 3B are drawings which show the internal structure of the discharge nozzle. To be more specific, FIG. 2 is a perspective view of the appearance of the discharge nozzle 31 for forming finger electrodes which is attached to the discharge unit 3. FIG. 3A is a cross sectional view of FIG. 2 taken along A-A' and FIG. 3B is a cross sectional view of FIG. 2 taken along B-B'.

The discharge nozzle 31 is made of stainless steel for instance, and as shown in these drawings, the appearance of the discharge nozzle 31 is generally like a cylindrical column with a cavity CV inside and the side surface at one of the ends of the discharge nozzle 31 (i.e., on the left below side in FIG. 2) is sliced obliquely from the both sides and shaped like a wedge. Of the two primary surfaces which form the wedge-like structure, the flat surface toward above in the Z-direction is denoted at 31 a and the flat surface toward below in the Z-direction is denoted at 31*b*. At the tip of the wedge, a plurality of projections 310 (five projections in this example) each having one discharge outlet 311 are arranged side by side in the X-direction.

Each discharge outlet 311 leads to the cavity CV inside the discharge nozzle 31. Describing in more specific terms, as shown in FIGS. 3A and 3B, a fluid feeding path 312 is provided which has a progressively reduced cross section from the cavity CV inside the discharge nozzle 31 toward the tip of the nozzle (i.e., the left-hand side in FIGS. 3A and 3B). The front-side end of the fluid feeding path 312 opens toward outside at the tip of the discharge nozzle 31, and defines the discharge outlet 311.

The other end of the discharge nozzle 31 is a joint section 31*c* which can be attached to and detached from the main section of the discharge unit 3. As the joint section 31*c* is fit to the main section of the discharge unit 3, the discharge nozzle 31 is held at the predetermined position relative to the substrate W which is mounted on the stage 14.

The cavity CV inside the discharge nozzle 31 forms an opening 31*d* which is open toward outside at the opposite end to the discharge outlet 311, and the application liquid is fed to the cavity CV through the opening 31*d*. As a piston rod not shown is inserted into inside the cavity CV via the opening 31*d*, a function as a syringe pump of pressurizing the application liquid stored inside the cavity CV as needed and discharging the application liquid from the discharge outlet 311 is realized.

The discharge nozzle 31 shown in FIG. 2 is chiseled out from a metal block of stainless steel for instance and is therefore one seamless structure.

Figure 4:
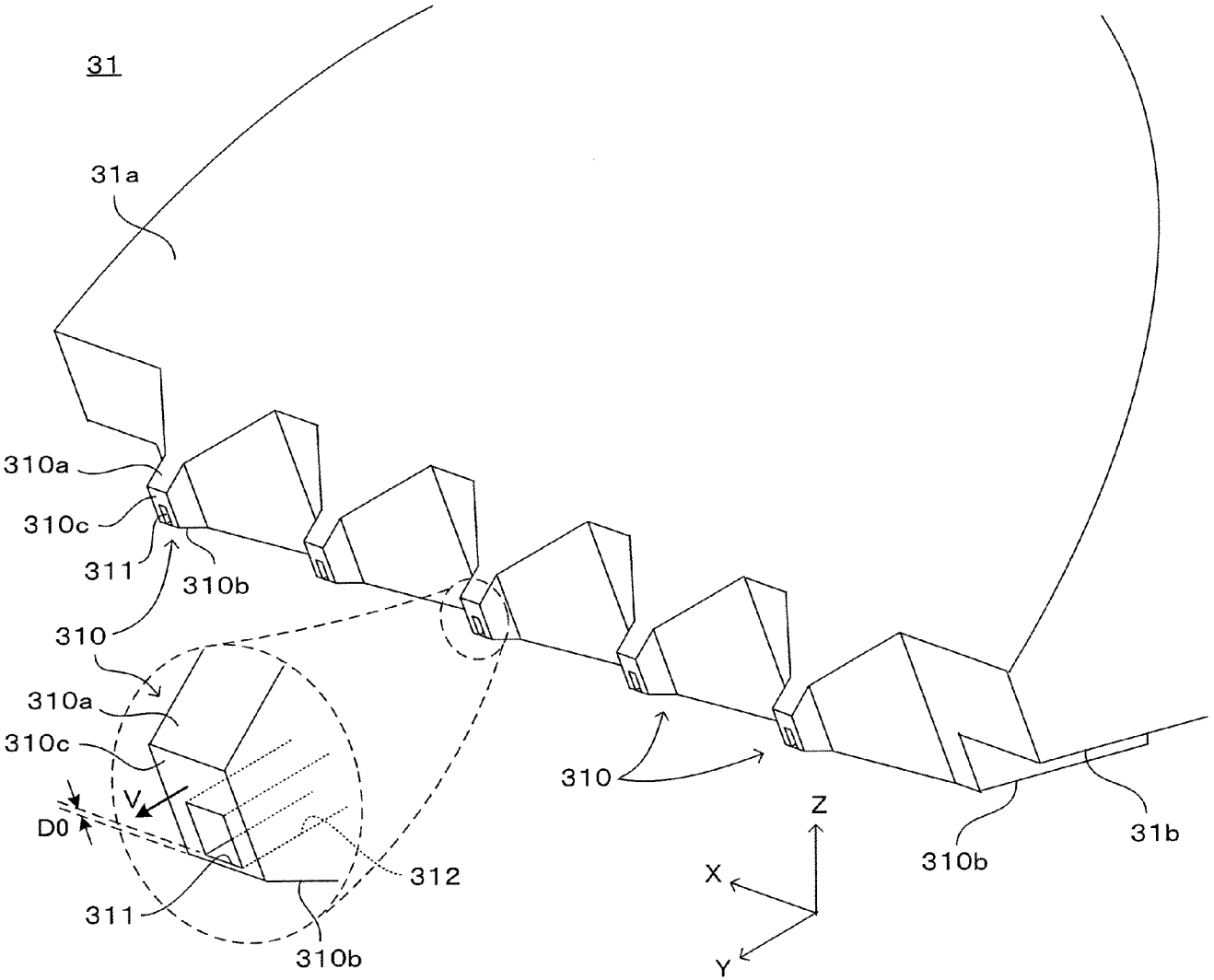
FIG. 4 is an enlarged view which shows the detailed structure of the tip section of the discharge nozzle.
Figure 5:
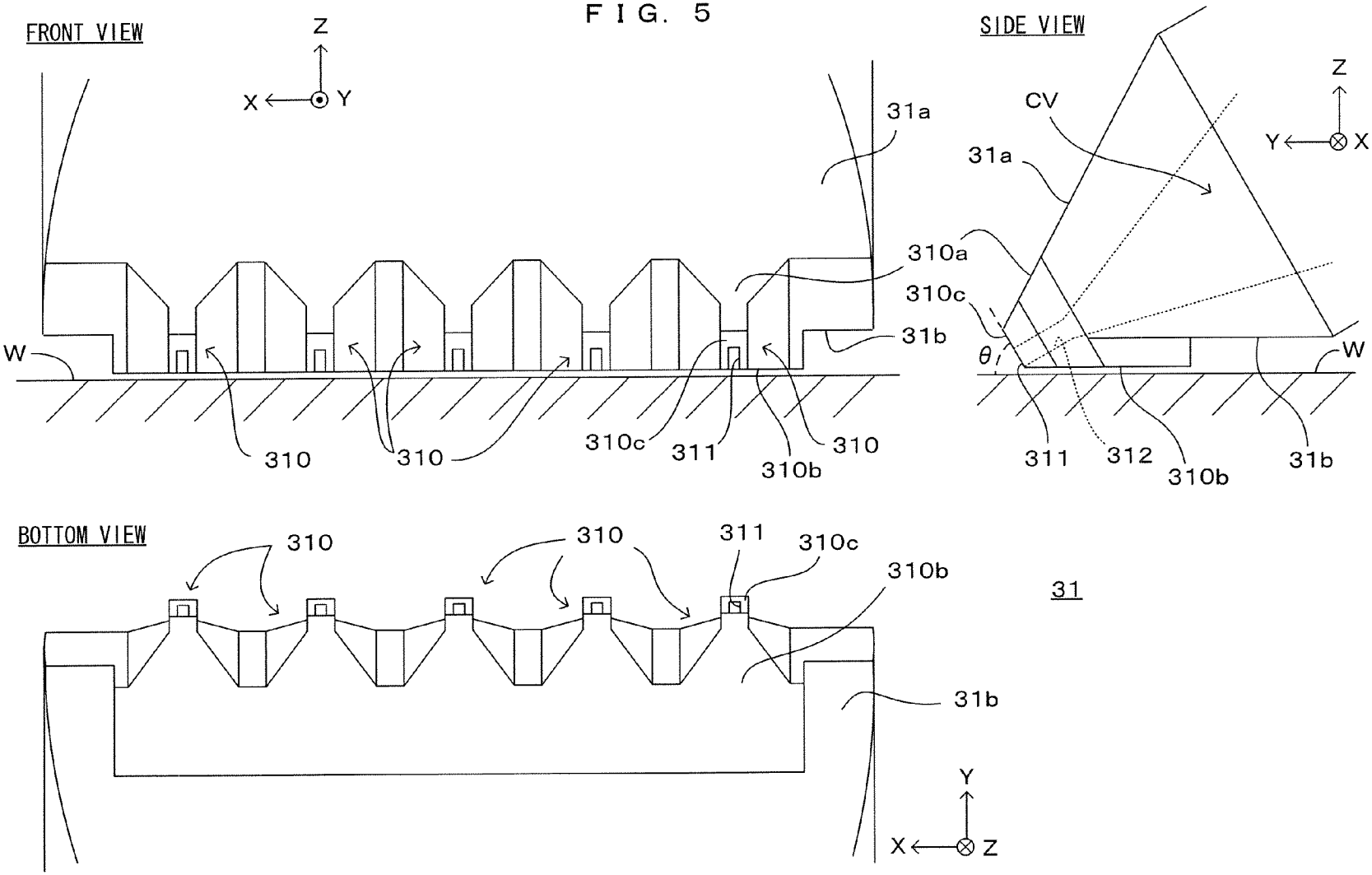
FIG. 5 is a drawing which shows the tip section of the discharge nozzle from front, side and bottom.

FIGS. 4 and 5 are enlarged views which show the detailed structure of the tip section of the discharge nozzle. More specifically, FIG. 4 is a drawing which contains a perspective view and a partially enlarged view which show the structure of the discharge outlet 311 disposed at the tip section of the discharge nozzle 31. FIG. 5 shows the tip section of the discharge nozzle 31 from front, side and bottom. With the discharge nozzle 31 attached to the discharge unit 3, the lower flat surface 31*b* of the tip section of the discharge nozzle 31 is held parallel to the surface of the substrate W mounted on the stage 14 over a predetermined distance from the substrate W.

At the tip end of the wedge which tapers toward the Y-axis positive direction and which is formed at one end of the discharge nozzle 31 by the flat surfaces 31*a* and 31*b*, the five projections 310 projecting further toward the Y-axis positive direction are provided in a row along the X-direction. Top surfaces 310*a* of the projections 310 are flush with the upper flat surface 31*a* of the discharge nozzle 31. Meanwhile, bottom surfaces of the projections 310 are flush with each other and define a plane which serves as a substrate-facing-surface 310*b* protruding beyond the lower flat surface 31*b* of the discharge nozzle 31 toward the substrate W. The substrate-facing-surface 310*b* is in the vicinity of the substrate W and approximately parallel to the surface of the substrate W. The gap between the substrate-facing-surface 310*b* and the substrate W is as small as possible like a few pm for instance, and is maximum about 100 μm.

Each projection 310 comprises a discharge outlet bearing surface 310*c* which contacts the substrate-facing-surface 310*b* at a position close to the tip of the substrate-facing-surface 310*b*, i.e., at an end position along the Y-axis positive direction. With a distance away from the contact with the substrate-facing-surface 310*b* in the Y-axis positive direction, the discharge outlet bearing surface 310*c* extends as if to retract back in the Z-axis positive direction from the surface of the substrate W. Among the components of the normal vector V of the discharge outlet bearing surface 310*c*, the one along the X-direction is zero, the one along the Y-direction is positive and the one along the Z-direction is negative. The discharge outlet 311 is formed in the discharge outlet bearing surface 310*c*, and the location of the discharge outlet 311 is deviated toward the substrate W. That is, within the discharge outlet bearing surface 310*c*, the discharge outlet 311 is provided at an adjacent position to the substrate-facing-surface 310*b*. As shown in FIG. 4, the gap D0 between the lower-end side rim of the discharge outlet 311 and the substrate-facing-surface 310*b* is as small as possible and ideally zero. When the gap D0 is zero, it means that one of the sides defining the substrate-facing-surface 310*b* which is on the Y-axis positive side coincides with a portion of the periphery of the discharge outlet 311.

The size of the discharge outlet 311 is approximately 20 through 50 μm in both the width direction, namely, the X-direction and the height direction, namely, the Z-direction. The size of the discharge outlet bearing surface 310*c* is approximately 150 μm in the width direction and approximately 200 μm in the height direction. As the discharged application liquid adheres to and spreads on the discharge outlet bearing surface 310*c* around the discharge outlet 311, the width of a pattern formed on the substrate W may become wider than the width of the opening of the discharge outlet 311. Since the maximum width of the pattern on such an occasion is approximately the same as the width of the discharge outlet bearing surface 310*c*, it is desirable that the width of the discharge outlet bearing surface 310*c* is approximately the same as the maximum tolerable width of the pattern. The discharge outlet 311 is formed in the discharge outlet bearing surface 310*c* which is located at the tip of the projection 310 protruding beyond the wedge-like tip of the discharge nozzle 31, and therefore, it is possible to suppress the spreading of the application liquid generally only to the width of the discharge outlet bearing surface 310*c*.

The discharge outlet 311 is formed in such an area of the discharge outlet bearing surface 310*c* which is closer to the substrate W and the substrate-facing-surface 310*b* of the discharge nozzle 31 is provided opposed to the surface of the substrate W and at such an extremely close position to the surface of the substrate W, thereby achieving the following effects. In short, as shown in the side view in FIG. 5, the distance from an opening plane in which the discharge outlet 311 is opened to the substrate W is extremely short where the configuration above is used. Hence, after fed under pressure to the discharge outlet 311 from the cavity CV inside the discharge nozzle 31 via the fluid feeding path 312 and pushed out from the discharge outlet 311 to the external space, a lower portion of the application liquid immediately contacts the substrate W.

In this embodiment, while the discharge nozzle 31 moves relative to the substrate W as the stage 14 seating the substrate W moves, the application liquid is applied onto the substrate W from the discharge nozzle 31. During this, if the distance from the discharge outlet 311 to the surface of the substrate W is long, the application liquid which has become free from friction with the surrounding wall after released from the discharge outlet 311 into the free space may remain around the discharge outlet 311 instead of heading for the substrate W right away or may fly into a different direction than the desired direction, which disturbs a pattern formed on the substrate W. This is a remarkable trend particularly when a highly viscous application liquid is extruded under a high pressure or the scanning speed of the discharge nozzle 31 relative to the substrate W is fast. This goes against the requirement to form a pattern having a high aspect ratio in a short period of time.

On the contrary, according to the embodiment, the distance from the discharge outlet 311 to the surface of the substrate W is extremely short and can be approximately zero in principle. It is therefore possible for the application liquid discharged at the discharge outlet 311 to reach the surface of the substrate W immediately, and the position at which the application liquid arrives at moves away from the discharge outlet 311 during scanning. Hence, the direction in which the discharged application liquid extends is limited and the application liquid is prevented from staying around the discharge outlet 311. In consequence, even when the application liquid is extruded with a high pressure or the scanning speed of the nozzle is fast, it is possible according to the embodiment to form a pattern whose cross-sectional shape is controlled or which elongates in a controlled direction.

Further, since the discharge nozzle 31 is formed as an integrated component, the path from the cavity CV to the discharge outlet 311 via the fluid feeding path 312 is completely seamless. This does not give rise to a pressure loss which could otherwise be caused by ooze of the application liquid from a seam under a high pressure. In this respect as well, the embodiment is preferable for control of the shape of a pattern during extrusion if the application liquid at a high pressure (of 1 MPa or higher for instance).

The reason why the lower flat surface 31*b* of the discharge nozzle 31 is not flush with the substrate-facing-surface 310*b* will now be described. As shown in FIG. 5, the bottom of the discharge nozzle 31 is not a single flat surface but has a two-step structure formed by the lower flat surface 31*b* and the substrate-facing-surface 310*b* which projects further toward the surface of the substrate W than the lower flat surface 31*b* does. The discharge outlet 311 is provided at the end of the substrate-facing-surface 310*b*. This is because the discharge outlet 311 is formed closer to the substrate W according to the embodiment, and therefore, if the bottom of the discharge nozzle 31 is a single flat surface, the nozzle housing becomes thin enough between the lower side wall of the fluid feeding path 312 and the bottom of the discharge nozzle 31 to surrender to the high pressure applied to the application liquid which is inside the nozzle housing. When the bottom of the discharge nozzle 31 is formed thick in a section close to the discharge outlet 311, it is possible to apply a high pressure upon the application liquid which is inside the nozzle housing. A section far from the discharge outlet can be formed adequately thick, the lower flat surface 31*b* may be stepped back to thereby make the entire nozzle light-weighted.

Further, as shown in FIG. 5 (front view) for example, the substrate-facing-surface 310*b* is not formed as wide as the discharge nozzle 31 along the X-direction but extends only to a little outside the outer-most discharge outlets 311 along the direction in which the discharge outlets 311 are arranged in one row (X-direction). Beyond there, the bottom of the nozzle retracts back to the flush plane with the lower flat surface 31*b*. The reason of this is as described below.

The discharge nozzle 31 according to the embodiment comprises the five discharge outlets 311 which are arranged in the X-direction. However, for fabrication of a photoelectric conversion device such as a solar battery in reality, it is necessary to form a greater number of (dozens or more) finger electrodes. In this embodiment, a number of finger electrodes are formed as the discharge nozzle 31 repeats scanning the substrate W in the Y-direction while changing the position of the nozzle in the X-direction.

While it is necessary to apply the application liquid during the second and subsequent scanning such that the scanning is located adjacent to a pattern which has been formed through the previous scanning over a constant gap, a part of the nozzle may touch and ruin the pattern which has already been formed, the bottom of the nozzle may get dirty or some other problem may arise during the second and subsequent scanning The shape of the bottom of the discharge nozzle 31 according to the embodiment is to avoid these problems.

Figure 6:
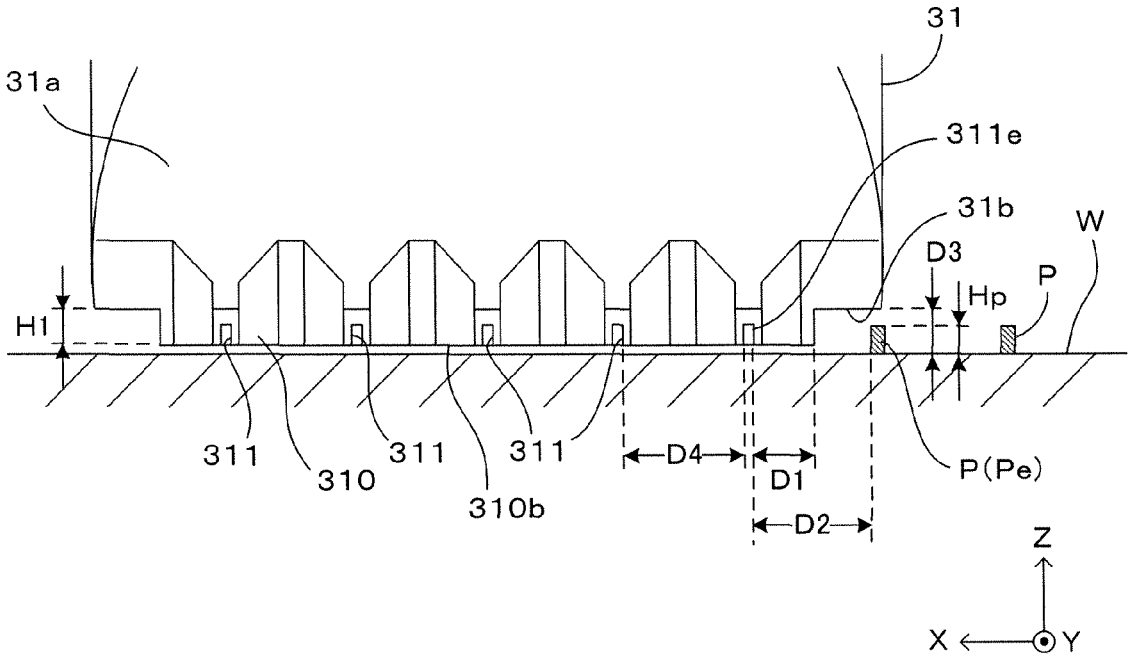
FIG. 6 is a drawing which shows the relationship between a pattern which has already been formed and the positions at which the nozzle moves passed the pattern.

FIG. 6 is a drawing which shows the relationship between a pattern which has already been formed and the positions at which the nozzle moves passed the pattern. An example of forming patterns which are at constant intervals in the X-direction through a plurality of scan movements of the discharge nozzle 31 will be considered. The intervals of patterns formed through one scan movement are constant and the same as the intervals at which the discharge outlets 311 are located. Hence, to form patterns at constant intervals on the substrate W as a whole, the quantity of feeding of the nozzle in the X-direction may be set so that the distance between the patterns formed through one scan movement and the patterns formed through the next scan movement becomes equal to the distance among the patterns formed through one scan movement. In other words, as shown in FIG. 6, the outermost outlet 311*e* among the discharge outlets 311 of the discharge nozzle 31 which moves passing the closest position to the outermost pattern Pe among patterns P which have already been made may so set to move passing a position which is away by the pattern intervals in the X-direction.

As FIG. 6 clearly shows, conditions for preventing the substrate-facing-surface 310*b* which is located in the vicinity of the surface of the substrate W from touching the pattern Pe which has already been are:

(1) that the width of the substrate-facing-surface 310*b* measured along the X-direction outside beyond the outer-most discharge outlet 311*e*, namely, a distance D1 between the discharge outlet 311 e and the X-direction edge surface of the substrate-facing-surface 310*b* is shorter than a distance D2 between the discharge outlet 311*e* and the pattern Pe which has already been formed; and (2) that a distance D3 between the lower flat surface 31*b* of the discharge nozzle 31 and the substrate W in the Z-direction is greater than the height Hp of the pattern Pe which has already been formed.

The condition (1) above is met when the distance D1 between the outermost discharge outlet 311*e* and the X-direction edge surface of the substrate-facing-surface 310*b* is smaller than the gaps D4 among the discharge outlets 311 which are next to each other. The condition (2) is met when a step height H1 between the substrate-facing-surface 310*b* and the lower flat surface 31*b* within the bottom of the discharge nozzle 31 is greater than the height Hp of a pattern to be formed. The shape of the bottom of the discharge nozzle 31 according to the embodiment satisfies these conditions. It is therefore possible for the discharge nozzle 31 to scan without touching a pattern which has been formed and it is possible to prevent damage to a pattern which has been formed, contamination of the nozzle, etc.

As described above, according to the embodiment, the projections 310 are provided at the wedge-shaped tip of the discharge nozzle 31 and the discharge outlets 311 for discharging the application liquid are formed in the discharge outlet bearing surfaces 310*c* which are located at the tips of the projections 310. The lower surfaces of the projections 310 define the substrate-facing-surface 310*b* which comes close and opposed to the surface of the substrate W. Within the discharge outlet bearing surfaces 310*c*, the discharge outlets 311 are open at such positions which are adjacent to the substrate-facing-surface 310*b*. These make it possible to apply the application liquid to the substrate W in a condition that the distance between the discharge outlets 311 and the surface of the substrate W is extremely short. As the application liquid discharged from the discharge outlets 311 immediately reaches the substrate W therefore, it is possible to prevent the application liquid from staying around the discharge outlets 311, to avoid distortion of a pattern made of the application liquid and hence to form a pattern which has a stable shape.

In addition, since the parts around the discharge outlets 311 and the fluid feeding path 312 leading to these parts are formed as one integrated structure, it is possible to prevent a problem that the application liquid oozes out from a seam between a plurality of parts. This permits applying a high pressure upon the application liquid inside the nozzle and extrusion of the application liquid. Further, as the path for the application liquid is realized as one integrated structure, the shape and the size of the path are not dependent upon the assembling accuracy, and therefore it is possible to control the size of a pattern better than before.

The configuration above according to the embodiment makes it possible to extrude the application liquid from the discharge outlets 311 at a high pressure, make the application liquid reach the substrate W as soon as the application liquid has been discharged, and stabilize the shape of the application liquid. It is therefore possible to adequately meet the requirement to form a pattern having a high aspect ratio in a short period of time using a highly viscous application liquid. Since the discharge nozzle 31 as a whole even including the cavity CV for storing the application liquid is formed as an integrated structure according to the embodiment, this effect is more remarkable.

Further, since the discharge outlets 311 are provided at the tips of the projections 310 which extend further beyond the nozzle tip, even when the discharged application liquid spreads around the discharge outlets 311, the spreading is restricted only to the coverage of the discharge outlet bearing surfaces 310*c*. Hence, it is relatively easy to control the width of a pattern which is formed on the substrate W and clean areas around the discharge outlets 311.

The angle (denoted at θ in the side view in FIG. 5) of the discharge outlet bearing surfaces 310*c* of the discharge nozzle 31 relative to the surface of the substrate W is preferably 30 through 60 degrees. While a pattern which is formed becomes taller as the angle θ is reduced, the nozzle housing in a lower section of the fluid feeding path becomes thin and accordingly weak and it becomes impossible to apply a high pressure upon the application liquid. When the angle θ is increased on the contrary, while the nozzle housing becomes rigid, the distance between the top ends of the discharge outlets and the substrate W cannot be long and the height of a pattern is therefore restricted. To ensure balance among these factors, the angle θ is preferably within the range of 30 to 60 degrees and more preferably 45 degrees for instance according to the findings by the inventors of the invention.

As described above, the stage 14 and the stage moving mechanism 15 respectively function as "the substrate holder" and "the moving member" of the invention. The discharge nozzle 31 functions as "the discharge head" of the invention, and the cavity CV, the discharge outlets 311 and the fluid feeding path 312 respectively correspond to "the fluid reservoir part," "the discharge outlet" and "the fluid feeding path" of the invention.

The invention is not limited to the embodiment described above but may be modified in various manners in addition to the embodiments above, to the extent not deviating from the object of the invention. For instance, while the discharge nozzle 31 according to the embodiment above comprises the five discharge outlets 311 which are arranged in the X-direction, the number of the discharge outlets is not limited to this but may be any desired number. The technical concept of the invention is viable even when only one discharge outlet is provided. Further, the shapes of the discharge outlets and the coating fluid feeding route are not limited to those described above.

For example, the same number of the discharge outlets as the number of patterns to be formed on a substrate may be provided in the discharge nozzle which has approximately the same width as the width of the substrate, in which case it is possible to form the necessary number of patterns through only one scan movement along the Y-direction. The movement in the X-direction between the substrate and the nozzle is therefore not necessary.

Further, although the embodiment above requires that the five projections 310 are provided at the tip of the discharge nozzle 31 and one discharge outlet 311 is formed in the discharge outlet bearing surface 310*c* which is located at the tip of each projection 310, a plurality of discharge outlets may be provided in a single discharge outlet bearing surface as described below.

Figure 7A:
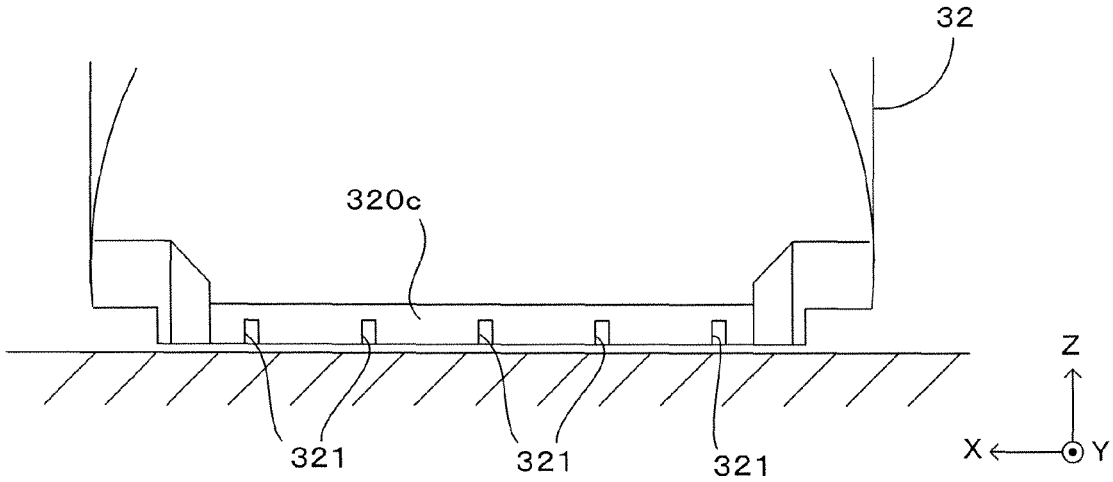
FIGS. 7A and 7B are drawings which show modification of the discharge nozzle.
Figure 7B:
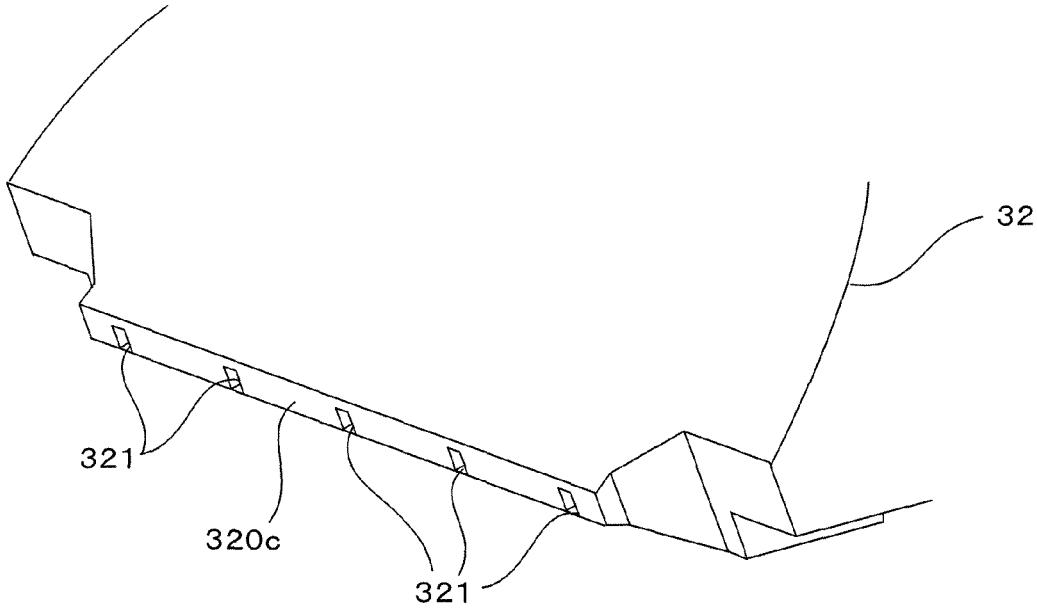

FIGS. 7A and 7B are drawings which show modification of the discharge nozzle. To be more specific, FIG. 7A and FIG. 7B are a front view and a perspective view, respectively, which show the appearance of a major part of a discharge nozzle 32 according to the modification. The modification is different from the embodiment described above only with respect to the shape of the tip of the discharge nozzle, and the other configurations are common to the embodiment above. The difference alone will therefore be described. In the discharge nozzle 32 according to the modification, the wedge-shaped tip of the nozzle has a single discharge outlet bearing surface 320*c* and a plurality of discharge outlets 321 are formed in the discharge outlet bearing surface 320*c*. Using such a configuration as well, it is possible to make the discharged application liquid immediately reach the substrate W and form a pattern having a stable shape as in the embodiment described above.

Further, since the shape of the nozzle tip is simpler and can be manufactured more easily and areas around the discharge outlets 321 are surrounded by the discharge outlet bearing surface 320*c* which has a relatively larger size as compared to the embodiment described above, the modification is superior to the embodiment above in terms of the rigidity of the areas around the discharge outlets 321. However, since the application liquid discharged from the discharge outlets 321 could spread along the discharge outlet bearing surface 320*c*, the embodiment above is superior in terms of pattern width control. The embodiment above and the modification may therefore be chosen in accordance with the purpose.

Further, while the embodiment above is related to application of the invention to the pattern forming apparatus 1 which is for manufacturing a photoelectric conversion device, the application of the invention is not limited to this. The invention is generally applicable to any apparatus which applies a pattern forming material onto a substrate and forms a predetermined pattern.

The invention is applicable to an apparatus for forming a pattern on a substrate, e.g., an electrode wiring pattern on a substrate for a solar battery. The invention is preferably applicable particularly to extrusion of the application liquid with a high pressure so as to form a pattern in a short period of time.

In the present invention, for instance, the side wall of the fluid feeding path, the substrate-facing-surface and the discharge outlet bearing surface may be integrated with each other. This allows thus integrated parts to form a structural unit which surrounds the fluid feeding path and the discharge outlet, thereby achieving the structure which is more resistant against a high pressure.

Further, for instance, an interior of the discharge head may be a cylindrical cavity and defines the fluid reservoir part, and a side wall of the cavity may be integrated with the side wall of the fluid feeding path, the substrate-facing-surface and the discharge outlet bearing surface. This makes even the wall which defines the cavity of the fluid reservoir part an integrated section of the integrated structure. Hence, there is no seam between parts against the flow of the application liquid from the fluid reservoir part to the surface of the substrate, which secures the effect above in an even more solid manner.

Further, the distance between the discharge outlet and the substrate-facing-surface may be zero. This attains almost zero time spent for the application liquid discharged from the discharge outlet to reach the surface of the substrate. It is therefore possible to apply the application liquid onto the surface of the substrate while maintaining the cross-sectional shape of the application liquid as it is right after the application liquid is discharged from the discharge outlet.

Further for instance, a plurality of the discharge outlet bearing surfaces may be provided in a width direction which is orthogonal to the scanning direction, and the discharge outlet may be formed in each one of the discharge outlet bearing surfaces. Alternatively, a plurality of discharge outlets may be provided in the discharge outlet bearing surface along the width direction which is orthogonal to the scanning direction for instance. With these structures, as the application liquid is discharged from each one of the discharge outlets, a plurality of patterns are formed through one scanning motion of the discharge head. Hence, the time required to form patterns on the substrate is even shorter.

In these configurations above, the plurality of discharge outlets may be equidistant from each other in the width direction and the width of the outer area of the substrate-facing-surface beyond the outer-most discharge outlet in the width direction may be narrower than the interval between the mutually adjacent discharge outlets. Where a number of equidistant patterns are to be formed, as the corresponding number of patterns to the number of the discharge outlets are formed through one scanning motion of the discharge head, and this operation may be repeated while changing the width-direction position of the discharge head relative to the substrate to different positions. As this is performed, the discharge head could contact a pattern which has been formed on the substrate and damage the pattern. This is a problem particularly when the substrate-facing-surface needs be positioned close to the surface of the substrate. However, where the configurations described above are used, the end of the substrate-facing-surface moves passed a position which is off the pattern which has already been formed, and therefore, it is possible to form equidistant patterns without damaging a pattern which has already been formed.

In the pattern forming apparatus of the invention, for instance, the angle of the discharge outlet bearing surface with respect to the surface of the substrate is desirable from 30 degrees to 60 degrees. If this angle is narrow, the distance between the surface of the substrate and the rear-side end of the discharge outlet taken along the scanning direction is short, which restricts the height of a pattern and is therefore inappropriate to form a pattern having a high aspect ratio. Meanwhile, an increase of this angle reduces the distance between the wall of the fluid feeding path and the substrate-facing-surface. This results in thinning of the wall of the fluid feeding path and makes the fluid feeding path less resistant against the pressure of the application liquid. This angle is preferably between 30 degrees and 60 degrees according to the findings obtained by the inventors of the invention.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A pattern forming apparatus, comprising:

a substrate holder which horizontally holds a substrate;

a discharge head which is disposed opposed to a surface of the substrate which is held by the substrate holder, the discharge head discharging an application liquid which contains a material for forming a pattern; and a moving member which makes the substrate held by the substrate holder move relative to the discharge head so that the discharge head moves in a predetermined scanning direction along the surface of the substrate, wherein:

the discharge head is made in a shape of a wedge of which a side surface at a lower end is sliced obliquely from both sides and comprises a fluid reservoir part for storing the application liquid inside, a discharge outlet for discharging the application liquid and a fluid feeding path for supplying the application liquid from the fluid reservoir part to the discharge outlet, at a tip of the wedge, a plurality of projections are arranged side by side in a width direction orthogonal to the scanning direction, bottom surfaces of the projections being flush with each other and each projection having one discharge outlet which discharges the application liquid, at a bottom of the discharge head, a two-step structure is formed by a lower flat surface which is one primary surface forming a shape of the wedge and a substrate facing surface which is a flush bottom surface of the projections and projects further toward the surface of the substrate than the lower flat surface does, each projection has a discharge outlet bearing surface which comes into contact with the substrate-facing-surface at the rear-side of the substrate-facing-surface taken along the scanning direction and recedes from the surface of the substrate with a distance away from the rear-side-end, the discharge outlet bearing surfaces being arranged in the width direction, the discharge outlet is provided at an adjacent position within the discharge outlet bearing surface which is adjacent to the rear-side end of the substrate-facing-surface, and a side wall of the fluid feeding path and the discharge outlet are formed as one integrated member.

2. The pattern forming apparatus of claim 1, wherein the side wall of the fluid feeding path, the substrate-facing-surface and the discharge outlet bearing surface are integrated with each other.

3. The pattern forming apparatus of claim 1, wherein an interior of the discharge head is a cylindrical cavity and defines the fluid reservoir part, and a side wall of the cavity is integrated with the side wall of the fluid feeding path, the substrate-facing-surface and the discharge outlet bearing surface.

4. The pattern forming apparatus of claim 1, wherein the distance between the discharge outlet and the substrate-facing-surface is zero.

5. The pattern forming apparatus of claim 1, wherein a plurality of the discharge outlets are formed within the discharge outlet bearing surface along a width direction which is orthogonal to the scanning direction.

6. The pattern forming apparatus of claim 1, wherein a plurality of the discharge outlets are located at equal intervals along the width direction, and a width of an outer region of the substrate-facing-surface beyond an outer-most discharge outlet taken along the width direction is smaller than the intervals of the discharge outlets which are adjacent to each other.

7. The pattern forming apparatus of claim 1, wherein the angle of the discharge outlet bearing surface with respect to the surface of the substrate is from 30 degrees to 60 degrees.

8. The pattern forming apparatus of claim 1, wherein the lower flat surface is parallel to the surface of the substrate.

9. The pattern forming apparatus of claim 1, wherein the discharge outlet bearing surfaces are arranged side by side.

* * * * *